United States Patent [19]

Winter et al.

[11] 4,450,893

[45] May 29, 1984

[54] METHOD AND APPARATUS FOR CASTING METALS AND ALLOYS

[75] Inventors: Joseph Winter, New Haven; Derek E. Tyler, Cheshire; Jonathan A. Dantzig, Hamden, all of Conn.

[73] Assignee: International Telephone and Telegraph Corporation, New York, N.Y.

[21] Appl. No.: 258,232

[22] Filed: Apr. 27, 1981

[51] Int. Cl.[3] ..... B22D 27/02

[52] U.S. Cl. ..... 164/468; 164/504; 164/459; 164/418; 164/900

[58] Field of Search ..... 164/459, 418, 138, 348, 164/443, 444, 485, 486, 468, 504, 487, 900

[56] References Cited

U.S. PATENT DOCUMENTS

| | | | |
|---|---|---|---|
| 2,672,665 | 3/1954 | Gardner et al. | 22/200.1 |
| 2,963,758 | 12/1960 | Pestel et al. | 164/468 X |
| 3,212,142 | 10/1965 | Moritz | 22/57.2 |
| 3,363,669 | 1/1968 | Wertli | 164/443 X |
| 3,612,151 | 10/1971 | Harrington et al. | 164/89 |
| 3,780,789 | 12/1973 | Unger | 164/444 X |
| 3,902,544 | 9/1975 | Flemings et al. | 164/900 X |
| 4,074,747 | 2/1978 | Takahashi et al. | 164/443 |
| 4,113,002 | 9/1978 | Fukuta et al. | 164/138 X |
| 4,211,270 | 7/1980 | Shinopulos et al. | 164/484 X |
| 4,229,210 | 10/1980 | Winter et al. | 164/488 X |

FOREIGN PATENT DOCUMENTS

| | | | |
|---|---|---|---|
| 1957332 | 11/1971 | Fed. Rep. of Germany | 164/418 |
| 53-16323 | 2/1978 | Japan | 164/487 |
| 2042385A | 9/1980 | United Kingdom . | |

*Primary Examiner*—Kuang Y. Lin

*Attorney, Agent, or Firm*—James B. Raden; Harold J. Holt

[57] ABSTRACT

A process and apparatus for continuously and semi-continuously casting molten metals and alloys. Control of the initial stages of solidification is carried out through application of a thermal insulating layer on the coolant side of a casting mold wall. The layer modifies the heat flux characteristics of the mold along a selected length thereof.

11 Claims, 10 Drawing Figures

METHOD AND APPARATUS FOR CASTING METALS AND ALLOYS

The instant invention relates to continuous or semi-continuous casting of molten metal and alloy ingots, such as for example ingots of aluminum, copper, and alloys thereof, and is particularly applicable to horizontal or vertical, reservoir fed casting of such ingots.

Casting molds used in continuous casting serve to contain molten metal and extract heat from the molten metal to form a solidified section. Such liners are typically monolithic and fabricated from conductive materials such as copper, aluminum, graphite, etc. Heat extraction is typically achieved by water cooling the outside of the liner.

Solidification proceeds from the point of initial contact between the molten metal and the water cooled mold. Typically, the solid shell that forms thickens and shrinks away from the mold before exiting the mold and being subjected to additional cooling. Use of a liner having a low thermal conductivity or a hot-top serves to move the initial solidification to the lower reaches of the casting mold, away from the molten metal surface thereby avoiding ingot surface defects that may result from entrapment of material from the molten metal surface. With or without such a liner or hot-top, the initial solidified shell is prone to hot tearing when the frictional forces imposed by the relative motion between shell and mold exceed the integrity of the shell. Such hot tears greatly impair ingot surface quality and, in the extreme, can lead to loss of castability.

In typical casting molds, with or without low thermally conductive liners or hot-tops, there is sudden and severe heat extraction rate at the area of the mold where the molten metal first contacts the chilled mold wall. Immediately upon contact the molten metal begins to chill and solidify. The accompanying severe high heat transfer rate is believed to directly or indirectly cause various problems. These include cold folds on the ingot surface, which themselves increase the susceptibility to heat tearing, high heat transfer rates which tend to increase the likelihood of the alloy being cast to segregate and may cause a concomitant lessening in ingot surface quality, and in ordinary direct chill (DC) casting, a high initial solidification rate which can result in a large columnar zone on the periphery of the ingot which in turn may lead to a lessening of performance in subsequent processing.

There is thus a need in continuous and semi-continuous casting of an economical, simple and efficient means of controlling initial solidification of a shell by controlling the thermal characteristics of the casting system, and it is an object of the present invention to fill this need.

A duplex mold for use in a slurry casting system is disclosed in U.S. patent application Ser. No. 184,089, filed Sept. 4, 1980, which is a continuation of U.S. patent application Ser. No. 15,059, filed Feb. 26, 1979. The slurry casting system disclosed therein utilizes magnetohydromagnetic motion associated with a rotating magnetic field generated by a two-pole multi-phase motor stator to achieve the required high shear rates for producing thixotropic semi-solid alloy slurries. In this type of system, the manifold which applies the coolant to the mold wall is preferably arranged above the stator. This can result in a portion of the mold cavity extending out of the region wherein an effective magnetic stirring force is provided. To overcome this problem, the upper region of the mold cavity is provided with a partial insulating mold liner having low thermal conductivity. The old liner extends down into the mold cavity for a distance sufficient to that the magnetic stirring forced field is intercepted at least in part by the mold liner and so that solidification within the mold cavity is postponed until the molten metal is within the effective magnetic field. The partial liner also acts to control heat transfer by keeping heat within the molten metal.

A process of controlling the rate of heat transfer in a heat conductive mold during DC casting is disclosed in U.S. Pat. No. 3,612,151 to Harrington et al. In this patent, the rate is regulated by controlling the casting speed in a specified range such that the line of solidification at the ingot surface, from the upstream conduction is in the vicinity of the junction between the conductive mold and an insulative reservoir or hot-top. The upstream conduction distance (UCD) is defined as the distance between the plane of wetting of a direct-chill coolant and the solidification line at the ingot surface due to direct-chill cooling alone. The disclosure in U.S. Pat. No. 3,612,151 also includes a mathematical relationship to determine the UCD. Systems such as these typically require casting system monitoring devices such as thermocouples and expensive or complex controls. In addition, there are certain inherent limitations as to the speed of casting which may be desirable or possible during a particular casting run.

It is also known to extract heat from at least two zones during a continuous casting run by utilization of such devices as hot-tops, heat extraction zones adjacent a chilled casting mold, linings on the casting or molten metal side of the mold or liner (U.S. Pat. No. 2,672,665 to Gardner et al.), and by use of multi-stage die portions of different refractory material (U.S. Pat. No. 4,074,747). Such systems as these require extensive modification of the casting mold or system and do not generally permit for a high degree of control at the precise area of interest.

Mold liners have also been used to solve friction and alignment problems in DC casting. For example, U.S. Pat. No. 3,212,142 to Moritz utilizes a mold which incorporates a short, tapered graphite liner or insert on the molten metal side of the mold wall. The insert acts to limit radial movement of heat thereby substantially avoiding the formation of a shell of solidified metal at the ingot periphery.

All of the aforementioned prior art patents require extensive modification of the casting mold or liner itself along the molten metal side of the liner and/or require a high degree of control of the casting system parameters, such as for example casting speed.

The present invention comprises a process and apparatus for controlling initial solidification of an ingot shell by controlling the thermal characteristics of the casting mold. The control is achieved by selectively applying a layer of thermally insulating material on the outside (water side) of the casting mold or liner. The layer reduces the local rate of heat extraction from the casting through the mold or mold liner into the cooling water, thereby slowing down the rate of initial shell formation.

In accordance with this invention, the insulating layer is to be the primary resistance to the flow of heat in the area of the mold or liner where the molten metal first comes into contact with the liner inside surface (molten metal side). It has been found that this is achieved when the minimum thickness d of the layer satisfies the relationship:

$$d \geqq \frac{2\,\delta\,\kappa\,(T_L - T_W)}{S\,R\,\rho\,Cp\,(T_I - T_L)}$$

where $\delta$ = width of layer
$\kappa$ = thermal conductivity of insulating layer
$T_L$ = liquidus temperature
$T_W$ = temperature of mold or liner cooling water
$S$ = casting speed
$R$ = radius of mold
$\rho$ = density of melt
$Cp$ = specific heat of melt
$T_I$ = melt inlet temperature Embodiments of the casting process and apparatus according to this invention are shown in the drawings, wherein like numerals depict like parts.

This invention discloses a process and means for regulating old or mold liner heat transfer rates during a casting run. High, uneven heat transfer rates in a casting mold tend to cause cold folds on the peripheral surface of the forming ingot. When utilizing a hot-top or a liner, these high transfer rates also tend to bring about solidification of molten metal or alloy so close to the hot-top or liner that the shell often contacts the hot-top or liner sticking to it and causing tears in the surface of the ingot and/or preventing metal from flowing out to the mold wall thereby causing incomplete filling. In the absence of a hot-top or liner, freezing-up often manifests itself in the entrapment of meniscus impurities into the ingot surface.

Figure 1:
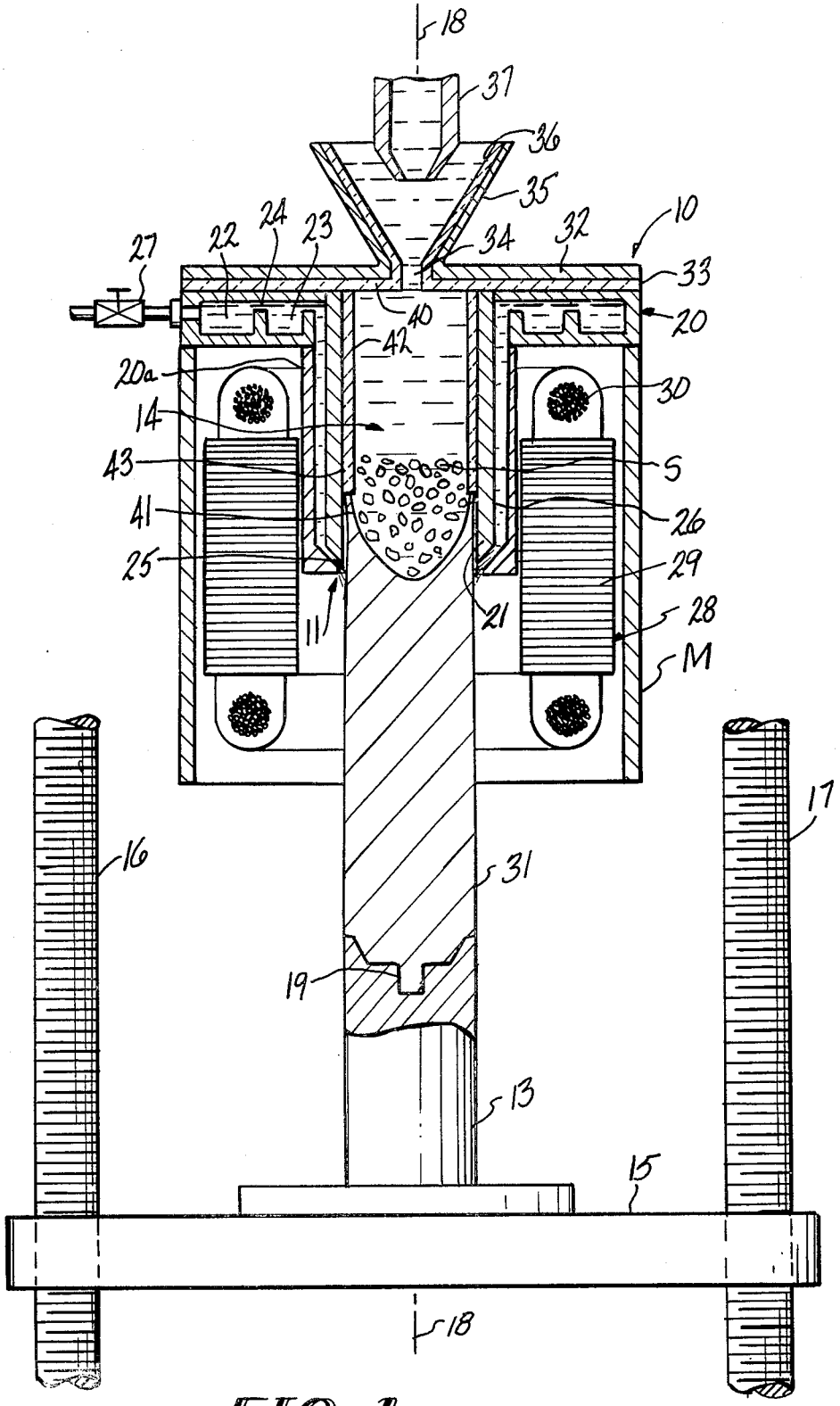
FIG. 1 is a schematic representation in partial cross-section of an apparatus for continuously or semi-continuously casting a thixotropic semi-solid metal slurry during a casting operation.

Referring to the drawings, FIG. 1 shows an apparatus 10 for continuously or semi-continuously slurry casting thixotropic metal slurries. Slurry casting as the term is used herein refers to the formation of a semi-solid thixotropic metal slurry, directly into a desired structure, such as a billet for later processing, or a die casting formed from the slurry.

The apparatus 10 is principally intended to provide material for immediate processing or for later use in various application of such material, such as casting and forging. The advantages of slurry casting include improved casting soundness as compared to conventional die casting. This results because the metal is partially solid as it enters the mold and, hence, less shrinkage porosity occurs. Machine component life is also improved due to reduced erosion of dies and molds and reduced thermal shock associated with slurry casting.

The metal compositon of a thixotropic slurry comprises primary solid discrete particles and a surrounding matrix. The surrounding matrix is solid when the metal composition is fully solidified and is liquid when the metal composition is a partially solid and partially liquid slurry. The primary solid particles comprise degenerate dendrites or nodules which are generally spheroidal in shape. The primary solid particles are made up of a single phase or a plurality of phases having an average composition different from the average composition of the surrounding matrix in the fully solidified alloy. The matrix itself can comprise one or more phases upon further solidification.

Conventionally solidified alloys have branched dendrites which develop interconnected networks as the temperature is reduced and the weight fraction of solid increases. In contrast, thixotropic metal slurries consist of discrete primary degenerate dendrite particles separated from each other by a liquid metal matrix, potentially even up to solid fractions of 80 weight percent. The primary solid particles are degenerate dendrites in that they are characterized by smoother surfaces and a less branched structure which approaches a spheroidal configuration. The surrounding solid matrix is formed during solidification of the liquid matrix subsequent to the formation of the primary solids and contains one or more phases of the type which would be obtained during solidification of the liquid alloy in a more conventional process. The surrounding solid matrix comprises dendrites, single or multi-phased compounds, solid solution, or mixtures of dendrites, and/or compounds, and/or solid solutions.

Referring to FIG. 1, the apparatus 10 has a cylindrical mold 11 adapted for continuous or semi-continuous slurry casting. The mold 11 may be formed of any desired non-magnetic material such as stainless steel, copper, copper alloy, aluminum or the like.

The apparatus 10 and process for using it is particularly adapted for making cylindrical ingots utilizing a conventional two pole polyphase induction motor stator for stirring. However, it is not limited to the formation of a cylindrical ingot cross section since it is possible to achieve a transversely or circumferentially moving magnetic field with a non-cylindrical mold 11. At this time, the preferred embodiment of apparatus 10 utilizes a cylindrical mold 11.

The bottom block 13 of the mold 11 is arranged for movement away from the mold as the casting forms a solidifying shell. The movable bottom block 13 comprises a standard direct chill casting type bottom block. It is formed of metal and is arranged for movement between a position wherein it sits up within the confines of the mold cavity 14 and a position away from the mold 11. This movement is achieved by supporting the bottom block 13 on a suitable carriage 15. Lead screws 16 and 17 or hydraulic means are used to raise and lower the bottom block 13 at a desired casting rate in accordance with conventional practice. The bottom block 13 is arranged to move axially along the mold axis 18. It includes a cavity 19 into which the molten metal is initially poured and which provides a stabilizing influence on the resulting casting as it is withdrawn from the mold 11.

A cooling manifold 20 is arranged circumferentially around the mold wall 21. The particular manifold shown includes a first input chamber 22 and a second chamber 23 connected to the first input chamber by a narrow slot 24. A coolant jacket sleeve **20*a* is attached to the manifold 20. The coolant jacket sleeve is also formed from a non-magnetic material. The coolant jacket sleeve 20*a* and the outer surface 26 of the mold 11 form a discharge slot 25. A uniform curtain of coolant, preferably water, is provided about the outer surface 26 of mold 11. The coolant serves to carry heat away from the molten metal via the inner wall of mold 11. The coolant exits through slot 25 discharging directly against the solidifying ingot 31. A suitable valving arrangement 27 is provided to control the flow rate of the water or other coolant discharged in order to control the rate at which the slurry solidifies. In the apparatus 10, a manually operated valve 27** is shown; however, if desired this could be an electrically operated valve or any other suitable valve.

The molten metal which is poured into the mold 11 is cooled under controlled conditions by means of the water sprayed upon the outer surface 26 of the mold 11 from the encompassing manifold 20. By controlling the rate of water flow against the mold surface 26, the rate of heat extraction from the molten metal within the mold 11 is in part controlled.

In order to provide a means for stirring the molten metal within the mold 11 to form the desired thixotropic slurry, a two pole multi-phase induction motor stator 28 is arranged surrounding the mold 11. The stator 28 is comprised of iron laminations 29 about which the desired windings 30 are arranged in a conventional manner to provide a three-phase induction motor stator. The motor stator 28 is mounted within a motor housing M. The manifold 20 and the motor stator 28 are arranged concentrically about the axis 18 of the mold 11 and casting 31 formed within it.

It is preferred to utilize a two pole three-phase induction motor stator 28. One advantage of the two pole motor stator 28 is that there is a non-zero field across the entire cross section of the mold 11. It is, therefore, possible to solidify a casting having the desired slurry cast structure over its full cross section.

A partially enclosing cover 32 is utilized to prevent spill out of the molten metal and slurry due to the stirring action imparted by the magnetic field of the motor stator 28. The cover 32 comprises a metal plate arranged above the manifold 20 and separated therefrom by a suitable ceramic liner 33. The cover 32 includes an opening 34 through which the molten metal flows into the mold cavity 14. Communicating with the opening 34 in the cover is a funnel 35 for directing the molten metal into the opening 34. A ceramic liner 36 is used to protect the metal funnel 35 and the opening 34. As the thixotropic metal slurry rotates within the mold 11, cavity centrifugal forces cause the metal to try to advance up the mold wall 21. The cover 32 with its ceramic lining 33 prevents the metal slurry from advancing or spilling out of the mold 11 cavity and causing damage to the apparatus 10. The funnel portion 35 of the cover 32 also serves as a reservoir of molten metal to keep the mold 11 filled in order to avoid the formation of a U-shaped cavity in the end of the casting due to centrifugal forces.

Situated directly above the funnel 35 is a downspout 37 through which the molten metal flows from a suitable furnace not shown. A valve member not shown associated in a coaxial arrangement with the downspout 37 is used in accordance with conventional practice to regulate the flow of molten metal into the mold 11.

The furnace not shown may be of any conventional design; it is not essential that the furnace be located directly above the mold 11. In accordance with convention casting processing, the furnace may be located laterally displaced therefrom and be connected to the mold 11 by a series of troughs or launders.

It is prefered that the stirring force field generated by the stator 28 extend over the full solidification zone of molten metal and thixotropic metal slurry. Otherwise, the structure of the casting will comprise regions within the field of the stator 28 having a slurry cast structure and regions outside the stator field tending to have a non-slurry cast structure. In the embodiment of FIG. 1, the solidification zone preferably comprises the sump of molten metal and slurry within the mold 11 which extends from the top surface 40 to the solidification front 41 which divides the solidified casting 31 from the slurry. The solidification zone extends at least from the region of the initial onset of solidification and slurry formation in the mold cavity 14 to the solidification front 41.

Under normal solidification conditions, the periphery of the ingot 31 will exhibit a columnar dendritic grain structure. Such a structure is undesirable and detracts from the overall advantages of the slurry cast structure which occupies most of the ingot cross section. In order to eliminate or substantially reduce the thickness of this outer dendritic layer, the thermal conductivity of the upper region of the mold 11 is reduced by means of a partial mold liner 42 formed from an insulator such as a ceramic. The ceramic mold liner 42 extends from the ceramic liner 33 of the mold cover 32 and has a lower edge projection 43. The ceramic mold liner 42 extends down into the mold cavity 14 for a distance sufficient so that the magnetic stirring force field of the two pole motor stator 28 is intercepted at least in part by the partial ceramic mold liner 42. The ceramic mold liner 42 is a shell which conforms to the internal shape of the mold 11 and is held to the mold wall 21. The mold 11 thus comprises a duplex structure including a low heat conductivity upper portion defined by the ceramic liner 42 and a high heat conductivity portion defined by the exposed portion of the mold wall 21.

The liner 42 postpones solidificaton until the molten metal is in the region of the strong magnetic stirring force. The low heat extraction rate associated with the liner 42 generally prevents solidification in that portion of the mold 11. Generally, solidification does not occur except towards the downstream end of the liner 42 or just thereafter. The shearing process resulting from the applied rotating magnetic field will further override the tendency to form a solid shell in the region of the liner 42. This region 42 or zone of low thermal conductivity thereby helps the resultant slurry cast ingot 31 to have a degenerate dendritic structure throughout its cross section even up to its outer surface.

Below the region of controlled thermal conductivity defined by the liner 42, the normal type of water cooled metal casting mold wall 21 is present. The high heat transfer rates associated with this portion of the mold 11 promote ingot shell formation.

It is preferred in order to form the desired slurry cast structure at the surface of the casting to effectively shear any initial solidified growth from the mold liner 42. This can be accomplished by insuring that the field associated with the motor stator 28 extends over at least that portion of the liner 42 where solidification is first initiated.

The dendrites which initially form normal to the periphery of the casting mold 11 are readily sheared off due to the metal flow resulting from the rotating magnetic field of the induction motor stator 28. The dendrites which are sheared off continue to be stirred to form degenerate dendrites until they are trapped by the solidifying interface 41. Degenerate dendrites can also form directly within the slurry because the rotating stirring action of the melt does not permit preferential growth of dendrites. To insure this, the stator 28 length should preferably extend over the full length of the solidification zone. In particular, the stirring force field associated with the stator 28 should preferably extend over the full length and cross section of the solidification zone with a sufficient magnitude to generate the desired shear rates.

To form an ingot 31 utilizing the apparatus 10 of FIG. 1, molten metal is poured into the mold cavity 14 while the motor stator 28 is energized by a suitable three-phase AC current of a desired magnitude and frequency. After the molten metal is poured into the mold cavity, it is stirred continuously by the rotating magnetic field produced by the motor stator 28. Solidification begins from the mold wall 21. The highest shear rates are generated at the stationary mold wall 21 or at the advancing solidification front 41. By properly controlling the rate of solidification by any desired means as are known in the prior art, the desired thixotropic slurry is formed in the mold cavity 14. As a solidifying shell is formed on the ingot 31, the bottom block 13 is withdrawn downwardly at a desired casting rate.

Figure 2:
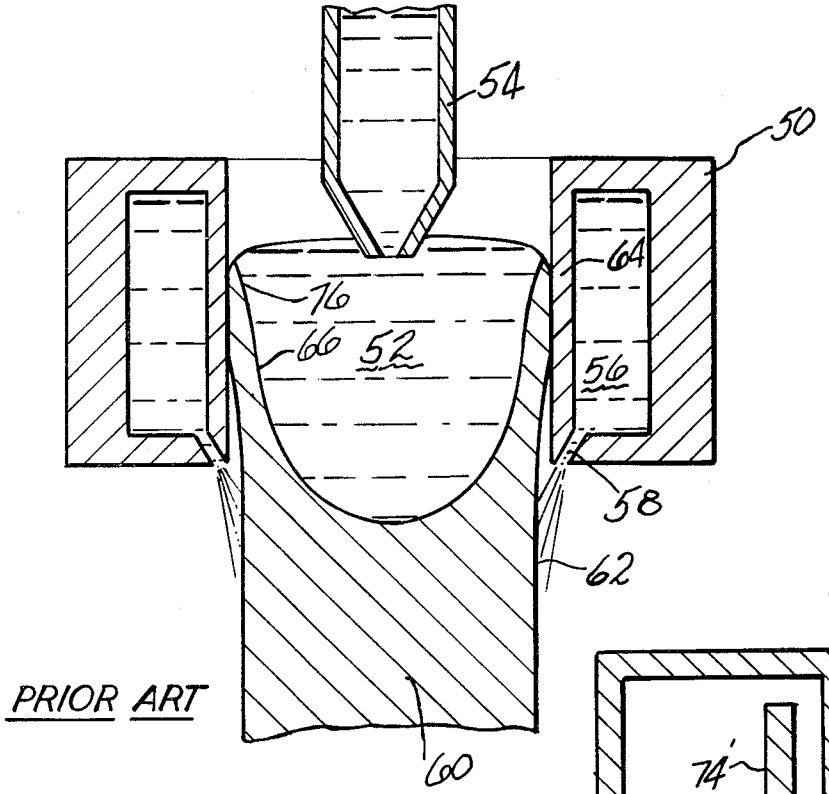
FIG. 2 is a front elevation view, in section, of a prior art DC casting system showing the relationships between the forming ingot and the mold.
Figure 6:
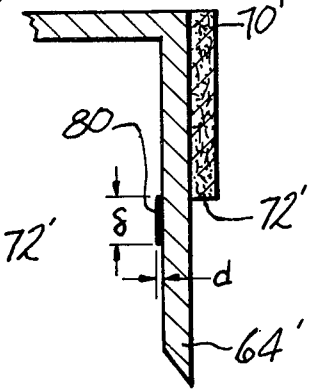
FIG. 6 is a partial section of the mold liner of FIG. 4, including a layer of insulating material applied in accordance with the present invention.

In FIG. 2, a typical prior art, direct-chill casting mold 50 is shown which forms and extracts heat from molten metal 52 which is supplied by molten metal feed spout 54. Coolant is supplied not shown to mold chamber 56 and exits through slot 58 discharging directly against the solidifying ingot 60 at 62. Coolant in chamber 56 also serves to carry away heat from molten metal 52 via inner wall 64 of mold 50. Liquid-solid interface 66 separates molten metal 52 from the solidifying ingot 60.

Figure 3:
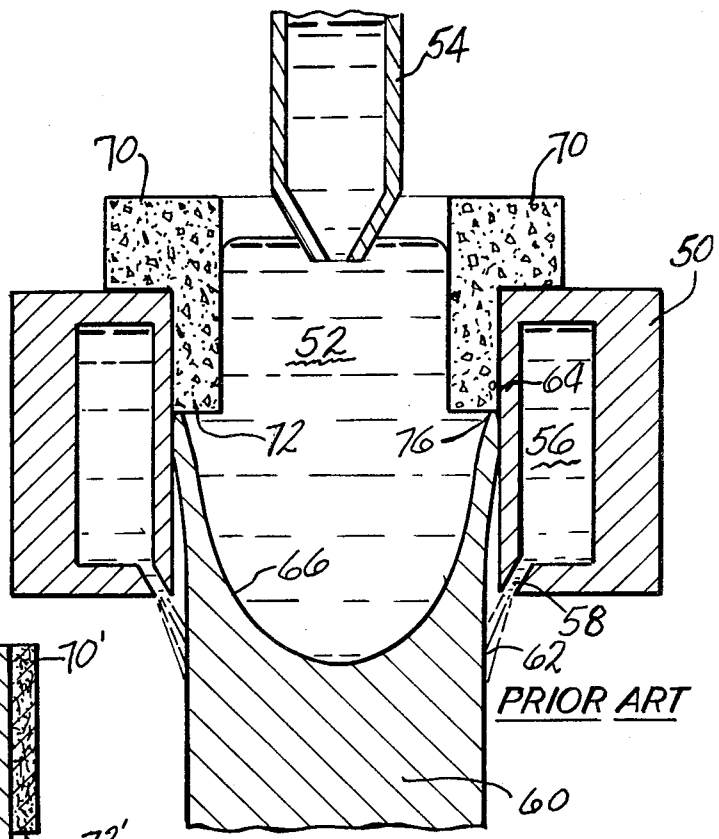
FIG. 3 is a front elevation view, in section, of a prior art DC casting system including a hot-top, showing the relationships between the forming ingot, the mold, and the hot-top.
Figure 4:
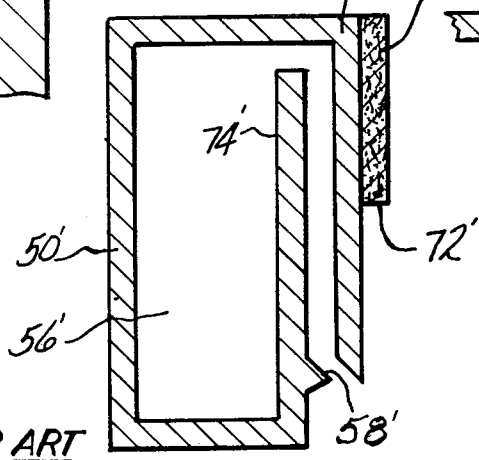
FIG. 4 is a partial section front elevation view of yet another prior art DC casting mold showing another type of mold liner and a hot-top.
Figure 5:
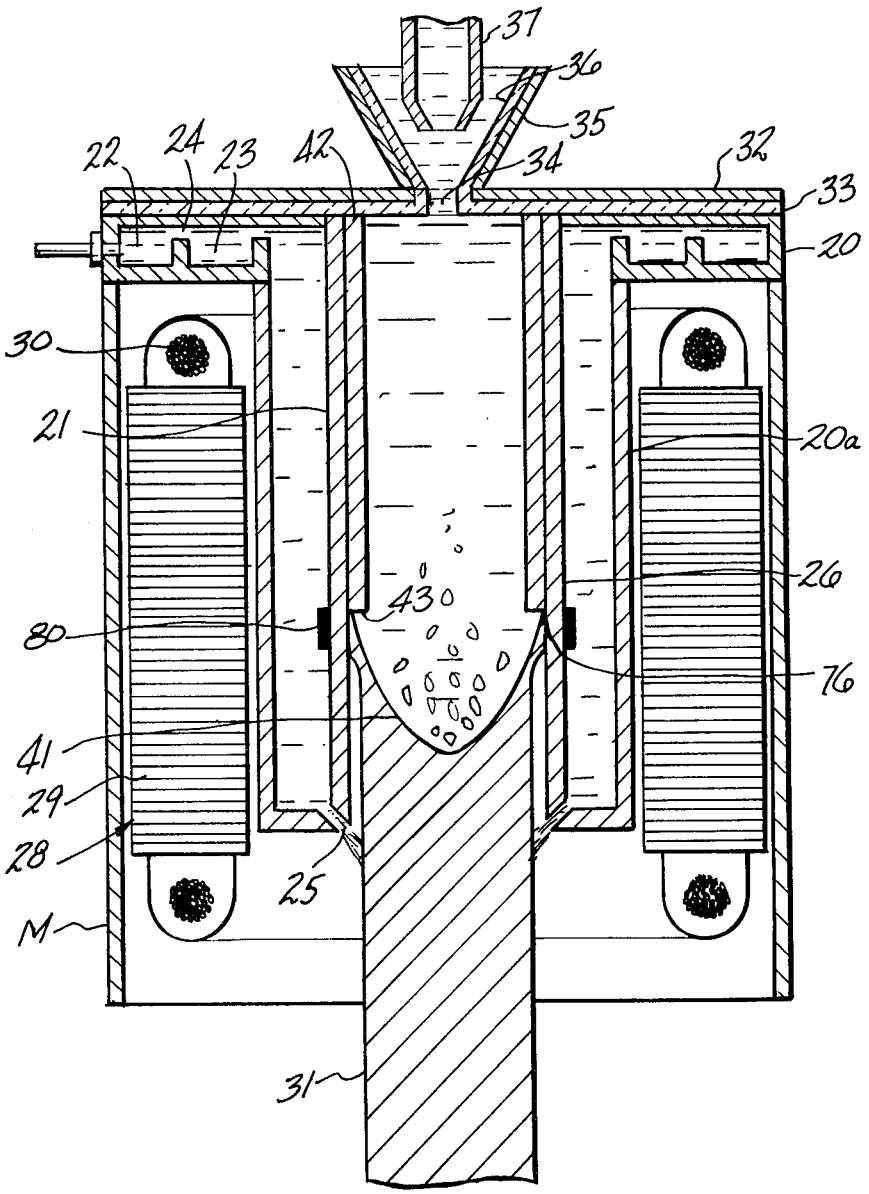
FIG. 5 is a front elevaton view, in section, of the mold liner of FIG. 1 including a layer of insulating material applied in accordance with the present invention and showing the relationships between the forming ingot, the mold, and the insulating layer.

FIG. 3 represents a prior art DC casting system which utilizes a hot-top 70 as an open top insulative reservoir. Reservoir or hot-top 70 includes a projection 72 inward from the inner surface of wall 64. Utilization of a hot-top is also depicted in FIG. 4 wherein a prior art casting mold 50' is shown. Casting mold 50' has water jacket sleeve 64' attached to and associated with a coolant chamber 56' and a wall 74'. Portions of wall 74' and sleeve 64' form a slot 58' for directing coolant from chamber 56' onto the surface of solidifying ingot 60. In DC casting, the molten metal 52 goes through a phase change, liquid to solid. The solidifying ingot 60 has different thermal properties than the molten metal 52 and tends to shrink away from inner mold wall 64 or sleeve 64', causing a change in the heat flux.

In accordance with the present invention, placement of a thermal insulating layer or band 80, as shown in FIGS. 5–8, on the coolant side of mold wall 21, mold wall 64 or sleeve 64' moderates the changes in the heat flux through mold wall 21, wall 64 or sleeve 64'. The thermal insulating layer of band 80 retards the heat transfer through mold wall 21, wall 64 or sleeve 64' and thereby tends to slow down the solidification of the molten metal and reduce the inward growth of solidification. The longitudinal extent or width $\delta$ of the band 80 can be selected so as to alter the sudden changes in heat flux through the wall in those areas where such sudden changes can be typically found. The area of interest typically is from about immediately after projection 43 of mold liner 42 of the slurry cast system, projection 72 of hot-tops 70 and 70' or the point of initial contact of molten metal with the inner mold walls to the point of initial solidification (point along ingot periphery were liquid-solid interface 41 or 66 contacts the inner surface of the mold wall). Normally, this distance is quite short because of the high heat flux through the inner mold wall at this particular area. By placing insulating band 80 along the coolant side of the mold wall 21, mold wall 64 or sleeve 64', this particular area of interest is enlarged as a result of the additional control of uniformity of heat flux through wall 21, wall 64, or sleeve 64'. Freezing of molten metal rather than occurring along a very short longitudinal distance of wall 21, wall 64 or sleeve 64' is now extended.

The following mathematical relationship for the thickness d of insulating band 80 has been derived as follows:

Assuming that the primary function of band 80 is to limit the flow of heat from or through wall 21, wall 64 or sleeve 64' in the region of mold liner projection 43, hot-top projection 72 or the point of initial molten metal contact with the wall 21, wall 64 or sleeve 64', the heat flux over the width of the band $\delta$ should be less than or equal to the heat associated with incoming melt superheat, that is $$2\pi R\delta q \leqq \pi R^2 S\rho Cp(T_I - T_L) \quad (1)$$

where

R = radius of mold
$\delta$ = width of band
q = heat flux
S = casting speed
$\rho$ = density of meet
Cp = specific heat of melt
$T_I$ = meet inlet temperature
$T_L$ = liquidus temperature Solving for q, we get $$q \leqq \frac{S\,R\,\rho\,Cp\,(T_I - T_L)}{2\,\delta} \quad (2)$$

It is the intention of the present invention that the insulating band 80 be the primary resistance to the flow of heat in this area of the mold, so that the heat flux may be approximated to be $$q = \frac{\kappa}{d}(T_L - T_W) \quad (3)$$

where $\kappa$=thermal conductivity of insulating band 80 d=thickness of insulating band 80

$T_W$=temperature of mold coolant

Substituting the expression for q from Equation (3) into Equation (2), we can solve for the minimum thickness d as $$d \geqq \frac{2\,\delta\,\kappa\,(T_L - T_W)}{S\,R\,\rho\,Cp\,(T_I - T_L)} \quad (4)$$

From Equation (4) it can be seen that as the conductivity of the insulating material of band 80 increases, so does the minimum thickness d. The relation between the thickness and the casting speed and width of band is explained by the effect of these parameters on contact time against mold wall 21, wall 64, or sleeve 64'.

Figure 8:
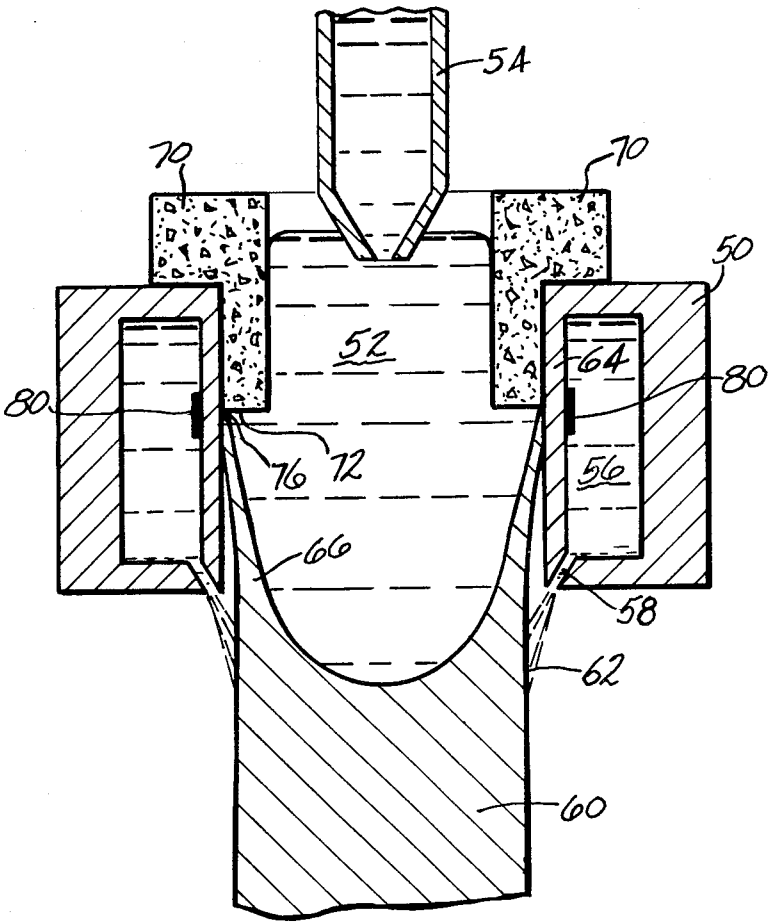
FIG. 8 is a front elevation view, in section, of a DC casting system such as that depicted in FIG. 3 including a layer of insulating material applied in accordance with the present invention and showing the relationships between the forming ingot, and hot-top, the mold, and the insulating layer.
Figure 7:
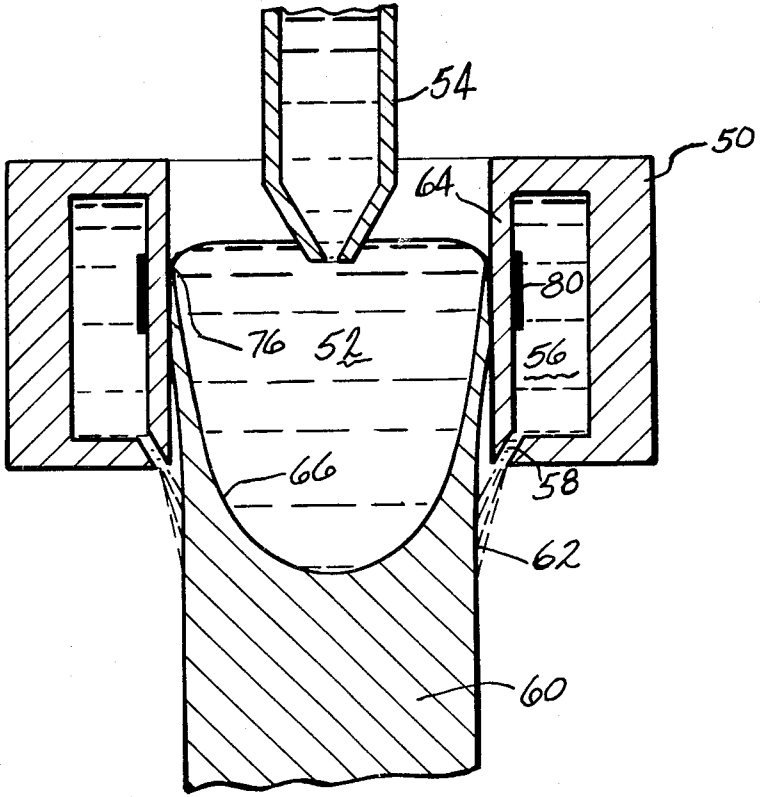
FIG. 7 is a front elevation view, in section, of a DC casting system such as that depicted in FIG. 2 including a layer of insulating material applied in accordance with the present invention and showing the relationships between the forming ingot, the mold, and the insulating layer.

It is of interest to note that in typical continuous casting systems quite thin insulating bands have been found to be effective. This can be readily appreciated from a consideration of the following casting system. Assuming a band width $\delta$=1 cm, $\kappa=10^{-4}$ cal/cm sec °K., $T_L$=700° C., $T_W$=100° C., S=25.4 cm/min, R=3.18 cm, $\rho$=2.37 g/cm$^3$, Cp=0.2 cal/g °K. and $T_I$=750° C., d is calculated in accordance with Equation (4) to be d≧0.038 mm=0.015 in. Thus, in accordance with this invention, insulating layers 80 which have been sprayed onto the outside (coolant) surface of wall 21, wall 64, or sleeve 64' have been found to be quite effective in preventing sudden changes in heat flux through the sprayed liner or wall along the sprayed (affected) zone. As shown in FIG. 8, the top of insulating band 80 may extend higher than hot-top projection 72 as a safety factor in preventing high heat transfer at that particular area. Likewise, the top of insulating band 80 may extend higher than the lower edge projection 43 of liner 42.

While it is contemplated that the bulk properties of the mold wall itself could be changed by means other than spraying or coating, as by altering mold wall material in the zone of interest or the affected area, such mold modifications would be unnecessarily complex and expensive. A variation of such an approach might be to machine out or form a slot on the outside surface (coolant side) of mold wall 21, wall 64, or sleeve 64' and thereafter insert solid bands of different materials and/or thicknesses. Such inserts on the inside (molten metal side) of wall 21, wall 64, or sleeve 64' would be less desirable in that discontinuities along the mold casting surface might be encountered. It should also be appreciated that insulating bands could be adhesively secured to the outside surface of the mold wall as an alternative to spraying or painting.

Any insulating material of lower thermal conductivity or diffusivity than the mold wall and that is stable in the coolant utilized in the casting process is suitable for use in the instant invention, as for example, metals with low thermal conductivity, metal alloys, oxides, metal oxides, any suitable polymeric coating material such as that desired by the trademark GLYPTAL, resins, enamel, epoxy, plastics, or any other suitable insulating material.

Figure 9:
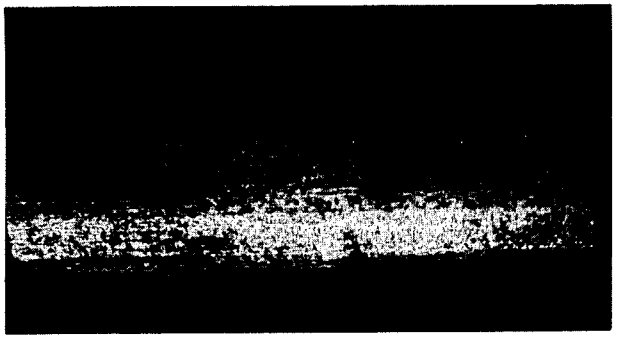
FIG. 9 is a photograph of a slurry cast ingot of aluminum alloy cast without an insulating layer.
Figure 10:
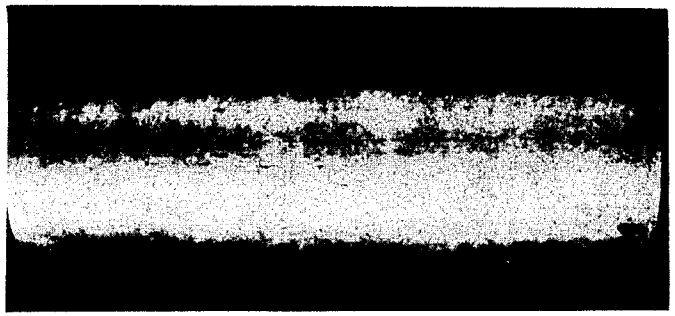
FIG. 10 is a photograph of a slurry cast ingot of aluminum alloy cast by the same process and apparatus as that used to cast the ingot depicted in FIG. 9 but including the use of an insulating layer in accordance with this invention.

The photograph of FIG. 9 shows a six inch diameter alloy AA 6061 casting which was continuously cast utilizing the casting apparatus depicted in FIG. 1. Casting was carried out at a temperature of 1280°-1300° F., a speed of 7 in/min, a field strength of 600 gauss, and a coolant flow rate of 26 gpm. The photograph of FIG. 10 depicts another six inch AA 6061 casting made utilizing the same casting apparatus and system parameters with the exception of the addition of a narrow (¾ inch wide) spray-on band of insulating material on the cooling water side of the casting mold liner. Use of the insulating band has the concomitant effect of reducing the thickness of the columnar zone on the periphery of the casting and reducing the severity of cold folding and inverse segregation.

The techniques described hereinabove in accordance with the present invention serve to vary the heat extraction rate associated with continuous casting systems smoothly from essentially zero to the normal value associated with a water cooled casting mold. This smooth transition permits growth and development of the ingot shell under controlled, less severe conditions. As a result, various benefits accrue. Firstly, meniscus related effects, such as cold folds associated with alternating freezing and meniscus formation are essentially eliminated. Consequently, the susceptibility to hot tearing is greatly reduced. Secondly, the slower solidification rate reduces the tendency for the alloy to segregate during the initial stages of casting. Accordingly, inverse segregation associated with the rapid cooling/reheating cycle will be reduced, with concomitant improvement in surface quality. The reduced initial solidification rate will also result in a smaller columnar zone on the periphery of the ingot, which leads to improved performance in subsequent processing.

It is envisaged that this invention can be used for casting all metals and alloys. Selection of the mold material, lubricant, coolant, etc. will be dependent upon the particular alloy or metal being cast and may be those typically utilized in the casting arts.

The United States patents and patent applications described hereinabove and the disclosures therein are intended to be incorporated by reference.

It is apparent that there has been provided with this invention a novel process and apparatus for varying the heat extracton rate associated with continuous casting systems smoothly from essentially zero to the normal value associated with a cooled casting mold which fully satisfy the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In an apparatus for continuously or semi-continuously forming a semi-solid thixotropic alloy slurry, said slurry comprising throughout its cross section degenerate dendrite primary solid particles in a surrounding matrix of molten metal, said apparatus comprising:

means for containing molten metal including a mold wall for containing and extracting heat from said thixotropic slurry, said containing means having a desired cross section;

means for controllably cooling said molten metal in said containing means; and means for mixing said molten metal for shearing dendrites formed in a solidification zone as said molten metal is cooled for forming said slurry;

said mixing means comprising a single two pole stator for generating a non-zero rotating magnetic field which moves transversely of a longitudinal axis of said containing means across the entirety of said cross section of said containing means and over said entire solidification zone, said moving magnetic field providing a magnetomotive stirring force directed tangentially of said containing means for causing said molten metal and slurry to rotate in said containing means, said magnetic force being of sufficient magnitude to provide said shearing of said dendrites, said magnetomotive force providing a shear rate of al least 500 sec. $^{-1}$;

the improvement wherein said apparatus comprises a first insulating layer extending over at least a portion of the inside surface of said mold wall and terminating at a lower edge projection within said mold wall, means for cooling said mold wall arranged about on outside surface of said mold wall; and a second insulating layer located along a specific length of the outside surface of said mold wall, said specific length beginning approximately at said lower edge projection of said first insulating layer and extending a predetermined distance below said projection, said second layer comprising a coating serving to alter the thermal characteristics of said mold wall along said length as compared to the remainder of said liner.

2. An apparatus as in claim 1 wherein said coating comprises an insulating material selected from the group consisting of polymers, resins, enamels, plastics, oxides, metals with low thermal conductivity, metal alloys, and metal oxides.

3. An apparatus as in claim 1 wherein the thickness of said insulating layer satisfies the following relationship:

$$d \geqq \frac{2\,\delta\,\kappa\,(T_L - T_W)}{S\,R\,\rho\,Cp\,(T_I - T_L)}$$

where $d$ = thickness of insulating layer
$\delta$ = width of insulating layer
$\kappa$ = thermal conductivity of insulating layer
$T_L$ = liquidus temperature
$T_W$ = temperature of mold coolant
$S$ = casting speed
$R$ = radius of mold
$\rho$ = density of molten metal
$Cp$ = specific heat of molten metal
$T_I$ = melt inlet temperature

4. An apparatus as in claim 1 wherein said slurry comprises degenerate primary solid particles in a surrounding matrix of molten metal; and said thixotropic slurry forming means comprises means for mixing said molten metal and creating a stirring force which causes said molten metal and slurry to rotate in said mold.

5. An apparatus as in claim 4 wherein said mixing and stirring force creating means comprises electromagnetic means for generating a magnetic field which moves transversely of a longitudinal axis of said mold.

6. An apparatus as in claim 5 wherein said electromagnetic means comprises a multi-phase, two pole induction motor stator surrounding said mold.

7. In a process for continuously or semi-continuously forming a semi-solid thixotropic alloy slurry, said slurry comprising throughout its cross section degenerate dendrite primary solid particles in a surrounding matrix of molten metal, said process comprising:

providing a means for containing molten metal having a desired cross section, said means including a mold wall for containing and extracting heat from said thixotropic slurry;

controllably cooling said molten metal in said containing means; and, mixing said contained molten metal for shearing dendrites formed in a solidification zone as said molten metal is cooled for forming said slurry;

generating solely with a two pole stator a non-zero rotating magnetic field which moves transversely of a longitudinal axis of said containing means across the entirety of said cross section of said containing means and over said entire solidification zone, said moving magnetic field providing a magnetomotive stirring force directed tangentially of said containing means for causing said molten metal and slurry to rotate in said containing means, said magnetomotive force being of sufficient magnitude to provide said shearing of said dendrites, said magnetomotive force providing a shear rate of at least 500 sec. $^{-1}$;

the improvement wherein said forming process comprises placing a first thermal insulating layer on said mold wall, said first insulating layer extending over at least a portion of the inside surface of said mold wall and terminating at a lower edge projection within said mold wall;

cooling said mold wall from an outside surface of said mold wall; and coating a second thermal insulating layer along a specific length of the outside surface of said mold wall, said specific length beginning approximately at said lower edge projection of said first insulating layer and extending a predetermined distance below said projection, said second coated layer serving to alter the thermal characteristics of said mold wall along said length as compared to the remainder of said mold wall.

8. A process as in claim 7 wherein said step of coating comprises spraying said insulating material onto said outside surface.

9. A process as in claim 8 wherein said coating comprises an insulating material selected from the group consisting of polymers, resins, enamels, plastics, oxides, metals having low thermal conductivity, metal alloys, or metal oxides.

10. A process as in claim 7 wherein the thickness of said insulative layer satisfies the following relationship:

$$d \geqq \frac{2\,\delta\,\kappa\,(T_L - T_W)}{S\,R\,\rho\,Cp\,(T_I - T_L)}$$

where $d$ = thickness of insulating layer
$\delta$ = width of insulating layer
$\kappa$ = thermal conductivity of insulating layer
$T_L$ = liquidus temperature
$T_W$ = temperature of mold coolant
$S$ = casting speed
$R$ = radius of mold
$\rho$ = density of molten metal
$Cp$ = specific heat of molten metal
$T_I$ = melt inlet temperature

11. A process as in claim 7 wherein said slurry comprises degenerate dendrite primary solid particles in a surrounding matrix of molten metal and said step of forming said thixotropic slurry comprises mixing said molten metal and creating a stirring force which causes said molten metal and slurry to rotate in said mold.

* * * * *